US010617223B2

(12) United States Patent
Bayer

(10) Patent No.: US 10,617,223 B2
(45) Date of Patent: Apr. 14, 2020

(54) INDEPENDENT SPRING SUPPORT STRUCTURE

(71) Applicant: Steven Bayer, Park Ridge, IL (US)

(72) Inventor: Steven Bayer, Park Ridge, IL (US)

(73) Assignee: Steven Bayer, Park Ridge, IL (US)

( * ) Notice: Subject to any disclaimer, the term of this patent is extended or adjusted under 35 U.S.C. 154(b) by 120 days.

(21) Appl. No.: 16/001,068

(22) Filed: Jun. 6, 2018

(65) Prior Publication Data

US 2019/0374041 A1 Dec. 12, 2019

(51) Int. Cl.

| | |
|---|---|
| ***A47C 27/07*** | (2006.01) |
| ***A47C 27/05*** | (2006.01) |
| ***A47C 27/06*** | (2006.01) |
| ***A47C 27/15*** | (2006.01) |
| ***A47C 27/045*** | (2006.01) |

(52) U.S. Cl.

CPC ..... *A47C 27/056* (2013.01); *A47C 27/0453* (2013.01); *A47C 27/068* (2013.01); *A47C 27/07* (2013.01); *A47C 27/15* (2013.01)

(58) Field of Classification Search

CPC . A47C 27/056; A47C 27/0453; A47C 27/068; A47C 27/07; A47C 27/15; F16F 3/00

USPC ..... 267/91, 101

See application file for complete search history.

(56) References Cited

U.S. PATENT DOCUMENTS

| | | | |
|---|---|---|---|
| 2,610,333 | A | 9/1952 | Piliero |
| 2,724,842 | A | 11/1955 | Rogovy |
| 3,083,381 | A | 4/1963 | Bailey |
| 5,636,396 | A | 6/1997 | Workman et al. |
| 5,987,678 | A | 11/1999 | Ayers |
| 6,397,418 | B1 | 6/2002 | Stjerna |
| 6,490,744 | B1 | 12/2002 | Schulz, Jr. |
| 7,685,663 | B2 | 3/2010 | Rawls-Meehan |
| 8,117,700 | B2 | 2/2012 | Howard |
| 8,181,296 | B2 | 5/2012 | Rawl-Meehan |
| 8,341,786 | B2 | 1/2013 | Oexman et al. |
| 8,857,799 | B2 | 10/2014 | Tyree |
| 9,119,478 | B2 | 9/2015 | DeFranks et al. |
| 9,144,320 | B1 | 9/2015 | Baker |
| 9,332,856 | B2 | 5/2016 | Eigenmann et al. |

(Continued)

FOREIGN PATENT DOCUMENTS

| | | | |
|---|---|---|---|
| GB | 202802 | A | 8/1923 |
| GB | 623273 | A | 5/1949 |

(Continued)

OTHER PUBLICATIONS

International Search Report and Written Opinion for related International Application No. PCT/US19/35573; report dated Aug. 26, 2019; (7 pages).

(Continued)

*Primary Examiner* — Xuan Lan Nguyen
(74) *Attorney, Agent, or Firm* — K&L Gates LLP

(57) ABSTRACT

A support structure and vertical isolation structure may include a plurality of spring coils and a mesh network. Each spring coil of the plurality of spring coils includes a spring, a cap, and a floating connector. The cap is configured to engage the spring. The floating connector is disposed in a middle of the spring. The mesh network secures a first spring coil of the plurality of spring coils to a second spring coil of the plurality of spring coils by passing through the floating connector of each of the first spring coil and the second spring coil.

20 Claims, 12 Drawing Sheets

(56) References Cited

U.S. PATENT DOCUMENTS

| | | | |
|---|---|---|---|
| 9,345,334 | B2 | 5/2016 | Mossbeck et al. |
| 9,380,883 | B1 | 7/2016 | Mossbeck |
| 9,603,460 | B2 | 3/2017 | DeFranks et al. |
| 9,661,932 | B2 | 5/2017 | Codos |
| 9,775,442 | B2 | 10/2017 | Mossbeck et al. |
| 9,848,711 | B2 | 12/2017 | Kilgore et al. |
| 2005/0251920 | A1 | 11/2005 | Ahn |
| 2008/0128965 | A1 | 6/2008 | Bock |
| 2010/0180385 | A1 | 7/2010 | Petrolati |
| 2011/0004998 | A1 | 1/2011 | Losio |
| 2014/0137333 | A1 | 5/2014 | DeFranks et al. |
| 2014/0283307 | A1 | 9/2014 | Corodemus |
| 2015/0026893 | A1 | 1/2015 | Garrett et al. |
| 2015/0320229 | A1 | 11/2015 | Edling et al. |
| 2016/0045034 | A1 | 2/2016 | Hager et al. |
| 2016/0311536 | A1 | 10/2016 | Schultheis et al. |
| 2016/0353893 | A1 | 12/2016 | Molenda |
| 2017/0318981 | A1 | 11/2017 | Duwell et al. |

FOREIGN PATENT DOCUMENTS

| | | | |
|---|---|---|---|
| KR | 20170004062 | A1 | 1/2017 |
| WO | 2003045197 | A1 | 6/2003 |
| WO | 2005002400 | | 1/2005 |
| WO | 2016156880 | | 10/2016 |
| WO | 2017153427 | | 9/2017 |
| WO | 2017206961 | | 12/2017 |

OTHER PUBLICATIONS

Mobelium; "Mattress Spring Topper" retrieved from https://mobelium.com/en/mattresses/603-mattress-spring-topper-26-8435441847730.html; (3 pages).

Dormeo; "Octaspring"; retrieved from https://www.dormeo.co.uk/octaspring.html; (3 pages).

INDEPENDENT SPRING SUPPORT STRUCTURE

BACKGROUND

Traditional sleep or rest support structures, such as furniture including mattresses, are often self-contained and entirely encased, which is a disadvantage. For example, a typical mattress employs a number of coil springs, encased in a frame and fabric material. The fabric material is typically a contiguous material that creates a taught and flat surface, which is unable to conform to particular forces such as those associated with the curves of a body or pressures generated by various body parts. Also, displacement of any individual spring may be affected by the fabric encasement. The fabric encasement affects how pressure is distributed across the support structure. Furthermore, fabric encasement makes it difficult to replace materials internal to the fabric encasement as they wear down. With a typical mattress, for example, coil or cushion failure results in the entire mattress being thrown away.

Though attempts have been made toward independent coil systems, these coil systems still suffer many of the disadvantages discussed above. For example, independent coils systems are typically still encased in fabric and fastened to one another via the fabric encasement. Thus, displacement of an individual spring can still affect other springs (e.g., via the fabric encasement). Likewise, direct access to the coil, the cushion, and other components is prevented by the fabric encasement. Thus, replacement of materials is still difficult.

Improved systems and devices for support structures and vertical isolation devices are therefore needed.

SUMMARY

Provided herein is a pixelated support structure that is not encased and is composed of a number of independent springs each of which has an independent topper. Each spring and topper is able to independently conform to the body shape and weight of a user. Likewise, each spring and topper is able to provide variable pressure support, independent of any adjacent spring and topper.

The systems and devices for support structures and vertical isolation devices herein are configured to provide independent support on an isolated (e.g., spring-by-spring) basis. In other words, the systems and devices allow for pressure to be distributed to an individual spring coil without affecting or displacing other spring coils. Furthermore, the systems and devices herein provide lateral rigidity among the spring coils, to ensure a self-contained structure. Also, the systems and devices herein are configured for simplified access and replacement of components on an isolated (e.g., spring-by-spring) basis.

In light of the disclosure herein, and without limiting the scope of the invention in any way, in a first aspect of the present disclosure, which may be combined with any other aspect listed herein unless specified otherwise, a support structure includes a plurality of spring coils and a mesh network. Each spring coil of the plurality of spring coils includes a spring, a cap, and a floating connector. The cap is configured to engage the spring. The floating connector is disposed in a middle of the spring. The mesh network secures a first spring coil of the plurality of spring coils to a second spring coil of the plurality of spring coils by passing through the floating connector of each of the first spring coil and the second spring coil.

In a second aspect of the present disclosure, which may be combined with any other aspect listed herein unless specified otherwise, the spring is a Bonnell coil spring.

In a third aspect of the present disclosure, which may be combined with any other aspect listed herein unless specified otherwise, each spring coil of the plurality of spring coils further includes a pad coupled to the cap.

In a fourth aspect of the present disclosure, which may be combined with any other aspect listed herein unless specified otherwise, the pad is coupled to the cap via hook-and-loop fasteners.

In a fifth aspect of the present disclosure, which may be combined with any other aspect listed herein unless specified otherwise, the pad has a hexagonal-shaped cross section.

In a sixth aspect of the present disclosure, which may be combined with any other aspect listed herein unless specified otherwise, the pad of each spring coil of the plurality of spring coils is geometrically fitted to provide a planar surface with every other pad of the plurality of spring coils.

In a seventh aspect of the present disclosure, which may be combined with any other aspect listed herein unless specified otherwise, the floating connector includes two voids, each of the two voids intersecting one another at a center of the floating connector, where the two voids are perpendicular to one another.

In a eighth aspect of the present disclosure, which may be combined with any other aspect listed herein unless specified otherwise, the floating connector is a spherical floating connector.

In a ninth aspect of the present disclosure, which may be combined with any other aspect listed herein unless specified otherwise, by securing the first spring coil to the second spring coil, the mesh network prevents lateral displacement by either of the first spring coil and the second spring coil while simultaneously allowing independent vertical displacement by either of the first spring coil and the second spring coil.

In a tenth aspect of the present disclosure, which may be combined with any other aspect listed herein unless specified otherwise, the plurality of spring coils is arranged in a rectangular array.

In a eleventh aspect of the present disclosure, which may be combined with any other aspect listed herein unless specified otherwise, a bottom end of each of the springs is seated in a retaining structure, the retaining structure including a wall that retains an outer periphery of the rectangular array.

In a twelfth aspect of the present disclosure, which may be combined with any other aspect listed herein unless specified otherwise, a vertical isolation structure includes a coil spring, a circular cap, a pad, and a floating connector. The circular cap includes two deflection arms, where each of the two deflection arms is configured to deflect to engage a top end of the coil spring. The pad is coupled to the circular cap. The pad has a hexagonal-shaped cross section. The floating connector is disposed in a middle of the coil spring. The floating connector includes two voids, each of the two voids intersecting one another at a center of the floating connector. The two voids are perpendicular to one another.

In a thirteenth aspect of the present disclosure, which may be combined with any other aspect listed herein unless specified otherwise, the coil spring is a Bonnell coil spring.

In a fourteenth aspect of the present disclosure, which may be combined with any other aspect listed herein unless specified otherwise, the pad is coupled to the circular cap via hook-and-loop fasteners.

In a fifteenth aspect of the present disclosure, which may be combined with any other aspect listed herein unless specified otherwise, the pad includes a first layer and a second layer, the first layer having a first firmness and the second layer having a second firmness that is different from the first firmness.

In a sixteenth aspect of the present disclosure, which may be combined with any other aspect listed herein unless specified otherwise, the floating connector is a spherical floating connector connected, via a mesh network passing through the floating connector, to a plurality of other vertical isolation structures at a plurality of other floating connectors.

In a seventeenth aspect of the present disclosure, which may be combined with any other aspect listed herein unless specified otherwise, responsive to the vertical isolation structure being displaced vertically, none of the plurality of other vertical isolation structures are displaced vertically.

In a eighteenth aspect of the present disclosure, which may be combined with any other aspect listed herein unless specified otherwise, vertical displacement includes compression of both the coil spring and the pad.

In a nineteenth aspect of the present disclosure, which may be combined with any other aspect listed herein unless specified otherwise, the coil spring further includes a coil loop, the coil loop positioned at a mid-point of the coil spring.

In a twentieth aspect of the present disclosure, which may be combined with any other aspect listed herein unless specified otherwise, a support structure includes a plurality of spring coils and a mesh network. Each spring coil of the plurality of spring coils includes a spring, a cap, and a connector. The cap is configured to engage the spring. The connector is disposed in an interior of the spring. The mesh network is configured to secure a first spring coil of the plurality of spring coils to a second spring coil of the plurality of spring coils by passing through the connector of each of the first spring coil and the second spring coil. Each of the first spring coil and the second spring coil are not displaceable in a lateral direction. Each of the first spring coil and the second spring coil are independently displaceable in a vertical direction.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been principally selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION OF EXAMPLE EMBODIMENTS

As discussed above, the systems and devices for support structures and vertical isolation devices are provided, among other significant advantages, to provide independent support on a spring-by-spring basis.

Figure 1:
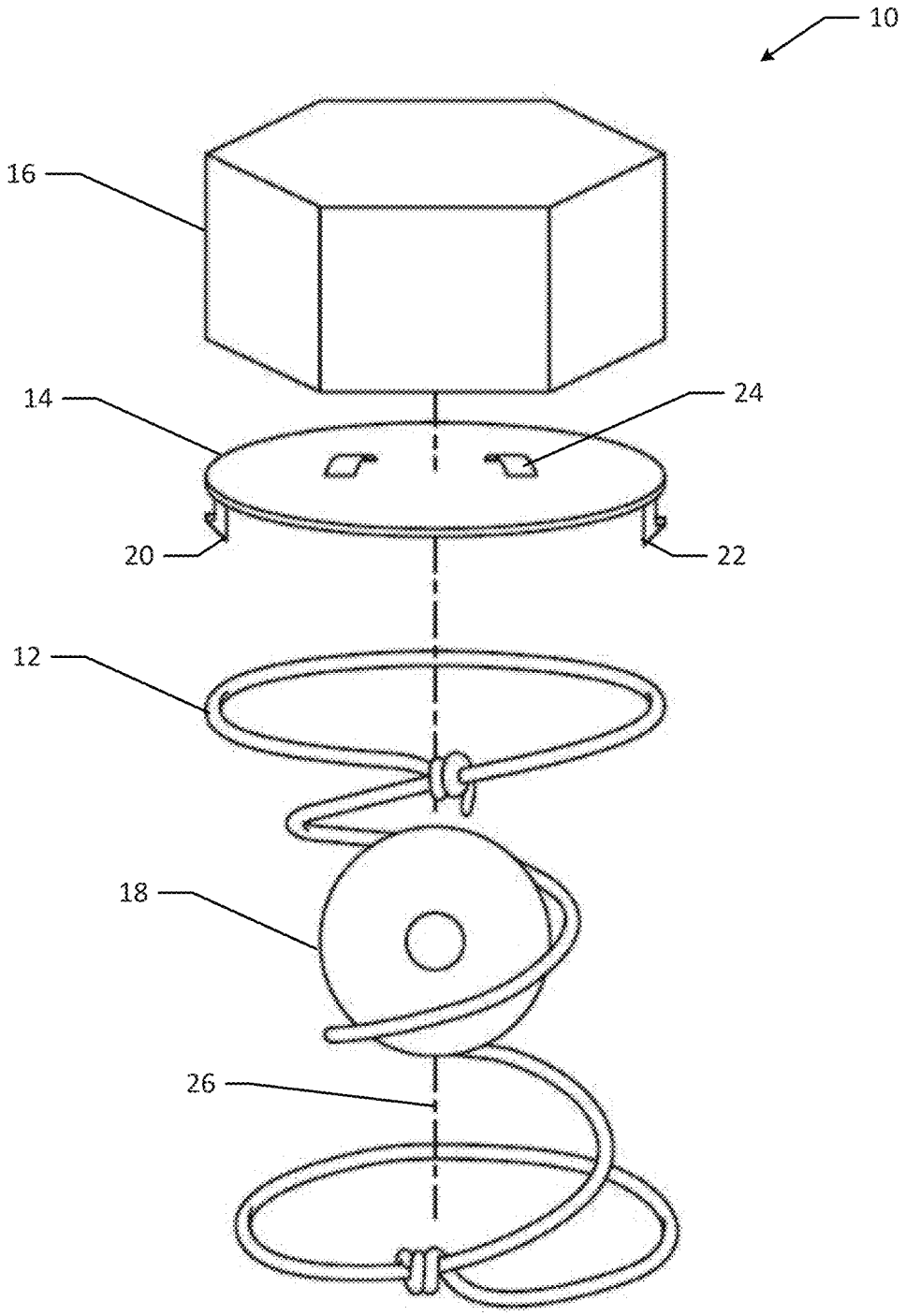
FIG. 1 is an exploded side elevation view of a vertical isolation structure, according to an example embodiment of the present disclosure.

FIG. 1 illustrates an exploded side elevation view of a vertical isolation structure, according to an example embodiment of the present disclosure. More particularly, FIG. 1 illustrates vertical isolation structure 10, which includes a coil spring 12, a cap 14, a pad 16, and a floating connector 18. In an embodiment, the coil spring 12 is a Bonnell type coil spring.

In an embodiment, the cap 14 is a circular cap. The cap 14 may further include deflection arms 20, 22. In an embodiment, the cap 14 includes two deflection arms 20, 22. In an alternate embodiment, the cap 14 includes more than two deflection arms 20, 22 (e.g., three or more). Each of the two deflection arms 20, 22 is configured to deflect to engage the coil spring 12 (e.g., a top end of the coil spring 12). Deflection arms 20, 22, and related engagement with coil spring 12, are described in greater detail below with respect to FIG. 4. In an alternate embodiment, the cap 14 engages with an end of coil spring 12 via other means. For example, cap 14 may include a circular groove, configured to snap or press-fit engage with the end of coil spring 12. In other examples, cap 14 may engage with coil spring 12 via straps, buckles, tape, or any other related means for mechanical engagement.

The pad 16 is coupled to the cap 14. In an embodiment, the pad 16 has a hexagonal-shaped cross section and a uniform height. It should be appreciated that pad 16 may be other cross sections (e.g., circular, triangular, square, octagonal, or any other related geometric profile). In an embodiment, the pad 16 is coupled to the cap 14 via hook and loop fasteners 24. In alternate embodiments, the pad 16 is coupled to the cap 14 via other means, such as snaps, straps, buckles, buttons, tape, or any other related means for mechanical coupling.

In one embodiment, the pad 16 is composed of a single compressive material, such as foam. In a different embodiment, the pad 16 is a multi-layer pad, composed of several layers of different materials. For example, pad 16 may include a first layer (e.g., a supporting material layer) and a second layer (e.g., a comfort layer), where each of the first and second layers have different firmness or compression values.

In an embodiment, the floating connector 18 is a sphere. In other embodiments, the floating connector 18 is another geometric shape, such as a square, rectangular, pyramid, diamond, or any other geometric shape. The floating connector 18 is disposed in a middle of the coil spring 12. For example, the floating connector 18 is disposed along a midpoint of the coil spring 12 and is disposed within the interior of the coil spring 12. The floating connector 18 is configured such that it is smaller than the interior diameter of the coil spring 12 at the midpoint of the coil spring 12.

It should be appreciated that, in typical embodiments, the components of vertical isolation structure 10 are aligned along a common axis. For example, each of the coil spring 12, the cap 14, the pad 16, and the floating connector 18 are aligned along vertical axis 26.

Figure 2A:
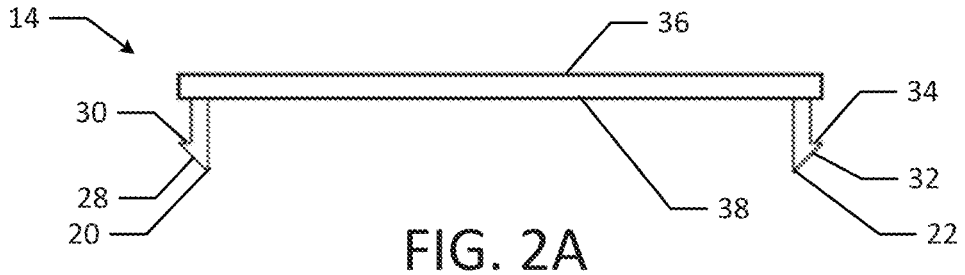
FIGS. 2A to 2B are side views of a cap, according to an example embodiment of the present disclosure.
Figure 2B:
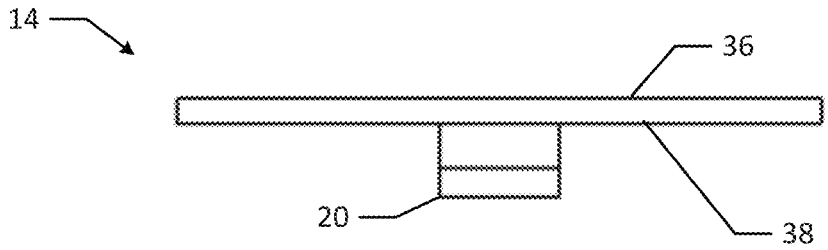

FIGS. 2A to 2B illustrate side views of a cap 14, according to an example embodiment of the present disclosure. Cap 14 includes a top surface 36 and a bottom surface 38. As described above, the top surface 36 of the cap 14 may be configured to couple to the pad 16 (e.g., via hook and loop fasteners 24). In an embodiment, cap 14 is composed of a plastic material, such as polypropylene, PVC, non DEHP PVC, polyethylene, polystyrene, polypropylene mixture, or other similar materials.

Furthermore, and as previously noted, cap 14 includes deflection arms 20, 22, which extend from the bottom surface 38 and are configured to deflect to engage the top end of the coil spring 12. Each of deflection arms 20, 22 includes a sloped face and a notch. For example, a first deflection arm 20 includes a first sloped face 28 and a first notch 30. Likewise, for example, a second deflection arm 22 includes a second sloped face 32 and a second notch 34. The first sloped face 28 and the second sloped face 32 may slope downward (e.g., toward the cap 14) and outward (e.g., towards the periphery of cap 14). The sloped faces 28, 32 may ensure, for example, proper inward deflection (e.g., toward the center of cap 14), for example, when the deflection arms 20, 22 engage with the coil spring 12. The deflection arms 20, 22 include notches 30, 34, which may engage the coil spring 12 to retain the cap 14 on the coil spring 12. This engagement is described in greater detail below with respect to FIG. 4.

Figure 2C:
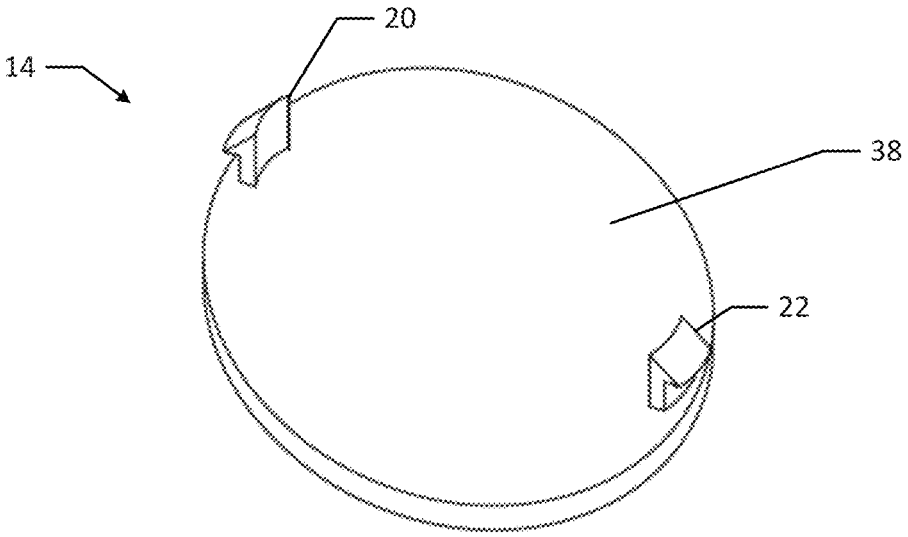
FIG. 2C is a side elevation view of the cap, according to an example embodiment of the present disclosure.

FIG. 2C illustrates a side elevation view of the cap 14, according to an example embodiment of the present disclosure. Particularly, cap 14 has a thin profile and a circular-shaped cross section. Each of deflection arms 20, 22 extend from the bottom surface 38 of the cap 14. Each of deflection arms 20, 22 may be positioned along the periphery of cap 14 and may further be aligned with one another, as illustrated by FIGS. 2B and 2C.

Figure 3A:
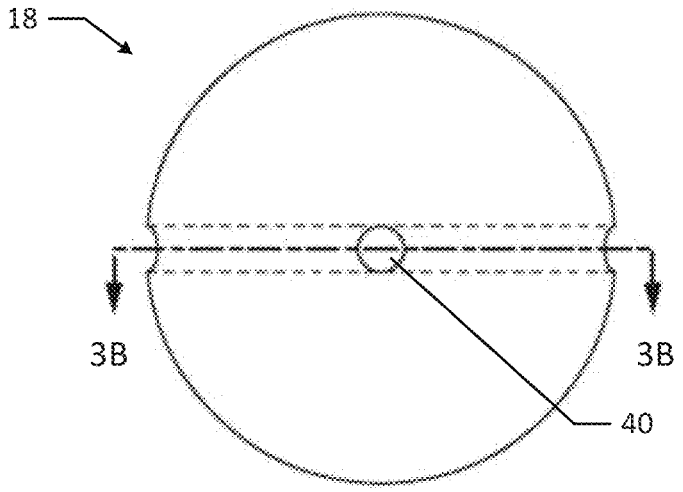
FIG. 3A is a side elevation view of a floating connector, according to an example embodiment of the present disclosure.

FIG. 3A illustrates a side elevation view of the floating connector 18, according to an example embodiment of the present disclosure. In an embodiment, the floating connector 18 is a spherical floating connector. In an embodiment, floating connector 18 is composed of a plastic material, such as polypropylene, PVC, non DEHP PVC, polyethylene, polystyrene, polypropylene mixture, or other similar materials. In a different embodiment, floating connector 18 is composed of a compressible material, such as foam or rubber.

Figure 3B:
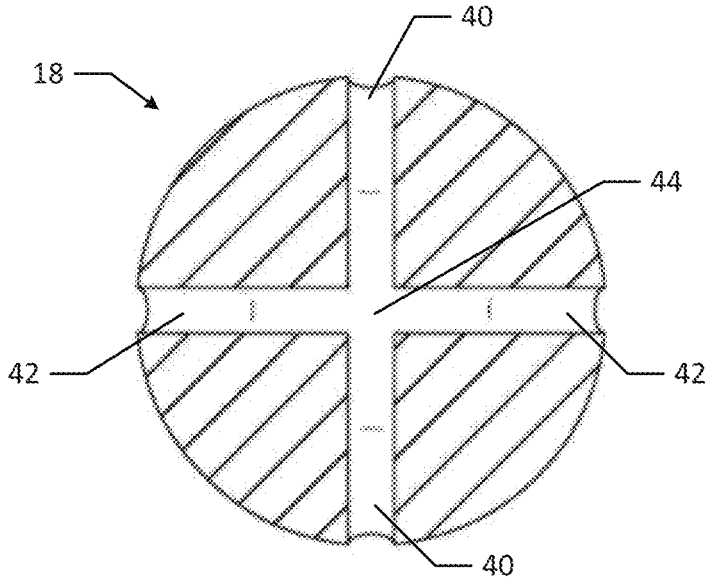
FIG. 3B is a side cut-away view of the floating connector, according to an example embodiment of the present disclosure.

With reference to FIG. 3B, which illustrates a side cutaway view of the floating connector 18, according to an example embodiment of the present disclosure, floating connector 18 includes two voids, a first void 40 and a second void 42. Each of the two voids 40, 42 intersect one another at a center 44 of the floating connector 18. Each of the two voids 40, 42 are perpendicular to one another and are co-planar with one another (e.g., co-planar in the cutaway plane indicated by FIG. 3B). In an alternate embodiment, the floating connector 18 includes more than two voids. For example, floating connector 18 may include three voids that are all perpendicular to one another and intersect one another at the center 44. In this embodiment, any two of the three voids are co-planar with one another while the third void of the three voids is normal to the co-planar plane that is defined by the other two voids. In a different alternate embodiment, the floating connector 18 is semi-hollow (e.g., a geometric shell) and includes a plurality of holes. For example, the floating connector 18 may be a spherical shell with at least six holes. In a different example, the floating connector 18 has many more holes (e.g., fifteen or more).

Figure 4:
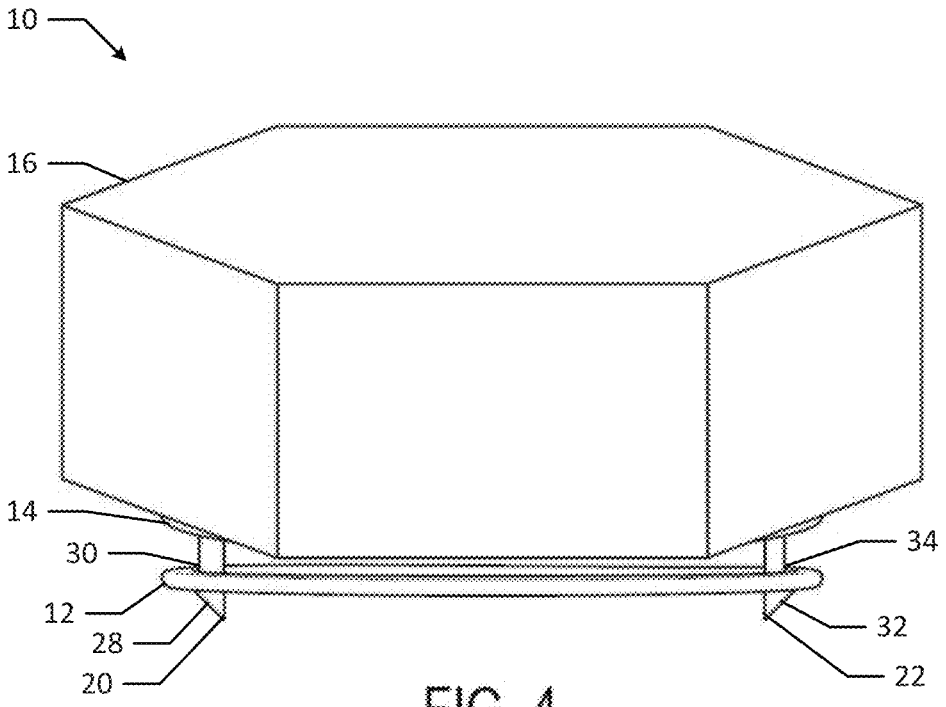
FIG. 4 is a side elevation view of the vertical isolation structure, according to an example embodiment of the present disclosure.

FIG. 4 illustrates a side elevation view of the vertical isolation structure 10, according to an example embodiment of the present disclosure. More particularly, FIG. 4 illustrates engagement between the cap 14 and the coil spring 12.

Typically, the end of the coil spring 12 forms a circular ring. Each of deflection arms 20, 22 are configured to deflect inward (e.g., toward the center of the cap 14) so that the end of the coil spring 12 (e.g. the circular ring) is retained around the outside of deflection arms 20, 22 in the notches 30, 34. As previously noted, inward deflection may be encouraged, for example, via the sloped faces 28, 32 of the deflection arms 20, 22.

In addition to or alternatively to the inward deflection of deflection arms 20, 22, it should be appreciated that coil spring 12 deflection may be implemented to ensure coil spring 12 retention by deflection arms 20, 22. For example, a user may manually compress the end of the coil spring 12, such that the previous circular ring forms an elliptical shape. The user may then insert the elliptical shaped coil spring 12 end around deflection arms 20, 22. Upon release of the end of the coil spring 12, the end of the coil spring 12 will revert back to the circular ring, and thus be retained by deflection arms 20, 22.

In an example embodiment, the depth of the notches 30, 34 (e.g., between the sloped faces 28, 32 and the cap 14) is approximately equivalent to the gauge of the coil spring 12. In this embodiment, the end of the coil spring 12 fits snugly in the notches 30, 34, and is retained between the notches 30, 34 and the bottom surface 38 of the cap 14.

Figure 5:
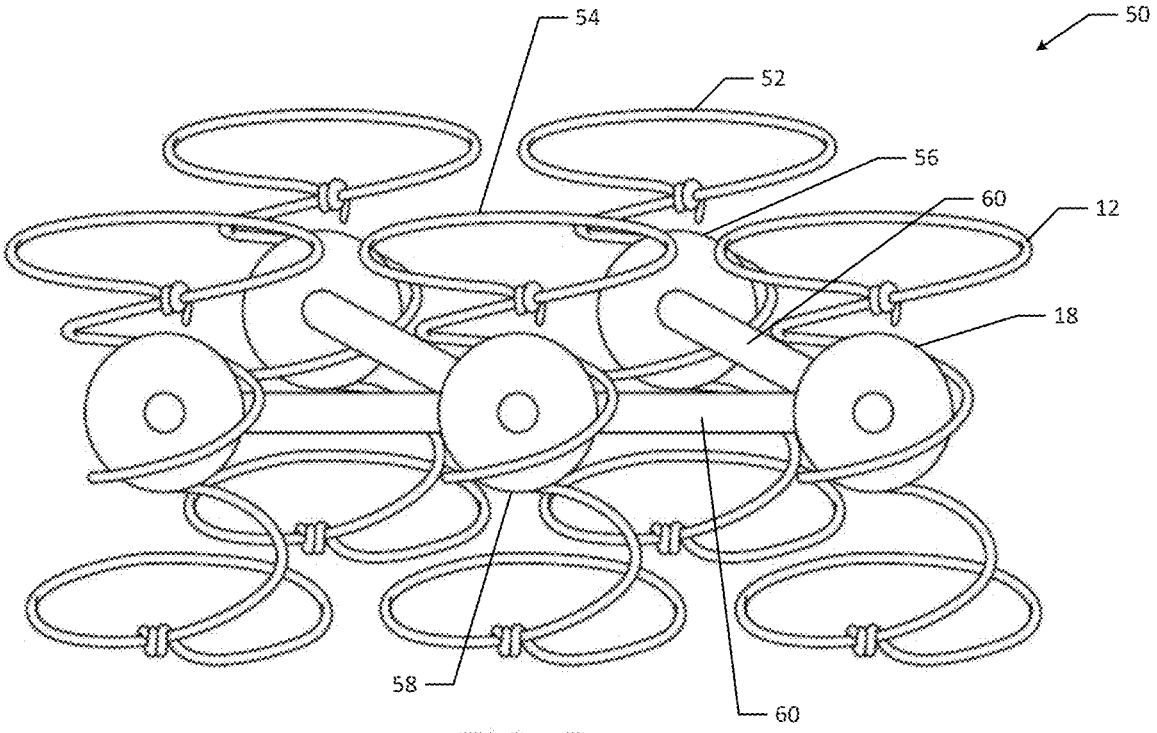
FIG. 5 is a side elevation view of a support structure, according to an example embodiment of the present disclosure.

FIG. 5 illustrates a side elevation view of a support structure 50, according to an example embodiment of the present disclosure. Support structure 50 may include the coil spring 12 and the floating connector 18, as previously described above. In addition to coil spring 12 and floating connector 18, the support structure 50 includes additional coil springs 52, 54, and additional floating connectors 56, 58. The additional floating connectors 56, 58 may include voids similar to voids 40, 42 of floating connector 18. It should be appreciated that support structure 50 may include additional components, such as those illustrated in FIG. 1 (e.g., cap 14, pad 16, and other related components).

Support structure 50 may further include a mesh network 60. The mesh network 60 may pass through the floating connector 18 (e.g., through one or both of the first void 40 and the second void 42) and through the additional floating connectors 56, 58 (e.g., through related voids). Further the mesh network 60 may pass through other floating connectors associated with other coils springs. By passing through the floating connector 18, and the additional floating connectors 56, 58, the mesh network 60 creates an array of floating connectors, which have lateral rigidity between each other. Furthermore, because the floating connector 18 is disposed in the middle of the coil spring 12, within the interior diameter of the coil spring 12, the array of floating connectors, provided by mesh network 60, further provides for lateral rigidity among each of the coil springs, such as coil spring 12. In an embodiment, the mesh network 60 is composed of a number of fabric strips, which are woven together. In other embodiments, the mesh network 60 is composed of twine, cable, or other related mechanical means for fastening the network of floating connectors 18, 56, 58 to one another.

As illustrated, the floating connector 18 and the additional floating connectors 56, 58 are disposed in the middle of the coil springs, such that they effectively "float." They are held in place by the mesh network 60, and are not attached directly to their respective coil springs. Again, though these floating connectors may "float" along a plane (e.g., a plane defined by mesh network 60), the floating connectors nonetheless provide for lateral rigidity.

The mesh network 60 may be configured to secure coil spring 12 to a number of other coil springs, such as additional coil springs 52, 54. For example, "securement" between coil spring 12 and additional coil springs 52, 54 may be provided via the mesh network 60 described above. In this example, the mesh network 60 does not directly secure coil spring 12 to additional coil springs 52, 54; rather, by passing the mesh network 60 through the floating connector 18, coil spring 12 is effectively "secured" to other coil springs (e.g., via other floating connectors). Further, coil spring 12 may be secured to other coil springs, beyond those depicted in FIG. 5. It should be appreciated that the mesh network 60 of the support structure 50 secures coil springs to one another in both rows and columns (e.g., an array). For example, mesh network 60 may secure coil springs to one another in both rows and columns, and may secure individual rows to adjacent rows and individual columns to adjacent columns. A particular arrangement for mesh network 60 is described in greater detail below, with reference to FIGS. 11 and 12.

Figure 6:
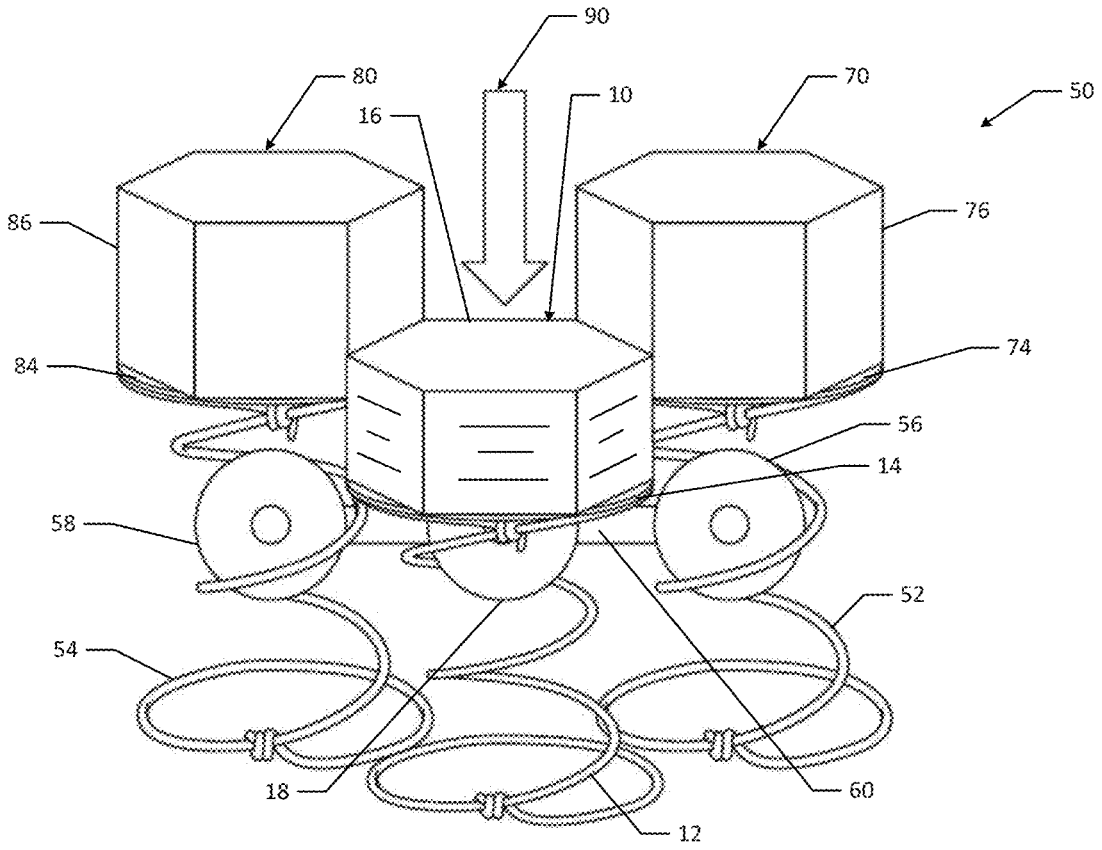
FIG. 6 is a side elevation view of a support structure, illustrating independent vertical deflection, according to an example embodiment of the present disclosure.

FIG. 6 illustrates a side elevation view of the support structure 50, illustrating independent vertical deflection, according to an example embodiment of the present disclosure. As noted above, support structure 50 may include additional components, beyond those illustrated.

Support structure 50 includes a number of vertical isolation structures, including the vertical isolation structure 10 and additional vertical isolation structures 70, 80. Each vertical isolation structure includes a spring. For example, vertical isolation structure 10 includes coil spring 12. Similarly, for example, vertical isolation structures 70, 80 include coil springs 52, 54, respectively. In an embodiment, the coil springs are Bonnell coil springs.

Each vertical isolation structure includes a cap, configured to engage a top end of the spring. For example, vertical isolation structure 10 includes cap 14, which engages the top end of coil spring 12. Similarly, for example, vertical isolation structure 70 includes cap 74, which engages the top end of coil spring 52; likewise, vertical isolation structure 80 includes cap 84, which engages the top end of coil spring 54.

Each vertical isolation structure includes a pad, coupled to the cap. For example, vertical isolation structure 10 includes pad 16, which is coupled to cap 14. Similarly, for example, vertical isolation structure 70 includes pad 76, which is coupled to cap 74; likewise, vertical isolation structure 80 includes pad 86, which is coupled to cap 84. In an embodiment, the pads are coupled to the caps via hook-and-loop fasteners.

Each vertical isolation structure includes a connector. For example, vertical isolation structure 10 includes floating connector 18. Similarly, for example, vertical isolation structure 70 includes floating connector 56; likewise, vertical isolation structure 80 includes floating connector 58. Each floating connector 18, 56, 58 is disposed in an interior of a respective spring. For example, floating connector 18 is disposed within an interior of coil spring 12. In an embodiment, the floating connectors are spherical floating connectors. In an embodiment, each floating connector includes two voids, which intersect one another at a center of the floating connector, and are perpendicular to one another. In a related embodiment, the two voids are co-planar.

Support structure 50 further includes the mesh network 60, as described above with respect to FIG. 5. The mesh network 60 is configured to secure a first vertical isolation structure (e.g., vertical isolation structure 10) to a number of other vertical isolation structures (e.g., vertical isolation structures 70, 80). The mesh network 60 secures the vertical isolation structure 10 by passing through the floating connector 18 (e.g., through voids 40, 42) and the floating connector of other vertical isolation structures (e.g., floating connector 56, 58).

The mesh network 60 ensures that the vertical isolation structures are laterally rigid with respect to one another. In other words, the mesh network 60 ensures that the vertical isolation structure 10 is not displaceable in a lateral direction with respect to the other vertical isolation structures 70, 80. Lateral rigidity is achieved in both rows and columns, such that an entire array of vertical isolation structures is laterally rigid. In an embodiment, lateral rigidity is further improved by securing the bottoms of each coil spring to a substructure. For example, lateral rigidity may be improved by securing clips to the bottoms of each coil spring, such that the entire array is coupled together via the clips.

The mesh network 60 further ensures that the vertical isolation structures are vertically independent. In other words, the mesh network 60 ensures that vertical isolation structure 10 is displaceable in a vertical direction independent of other vertical isolation structures 70, 80. For example, a force 90 on vertical isolation structure 10 is translated to a vertical displacement of vertical isolation structure 10, which includes a displacement of both the pad 16 and the coil spring 12. Notably, neither of the other vertical isolation structures 70, 80 are displaced when the vertical isolation structure 10 is vertically displaced. Individual and independent deformation ensures that an individual vertical isolation structure may independently conform to the body shape of the user while providing variable pressure support independent of any adjacent vertical isolation structures. For example, vertical isolation structures that experience larger displacement forces (e.g., near the user's torso or hips) and may deform more than vertical isolation structures that experience smaller displacement forces (e.g., near the user's head or feet). Displacement of one vertical isolation structure does not affect displacement of other vertical isolation structures.

Furthermore, in a typical embodiment, neither the floating connector 18 nor the mesh network 60 is displaced. This is largely due to the fact that the floating connector 18 "floats" and is thus not attached to the coil spring 12. In other words, the rigidity of the mesh network 60, including the lateral rigidity imposed on the vertical isolation structure 10 and other vertical isolation structures, is not affected by vertical displacement of the vertical isolation structure 10. In this way, displacement of one vertical isolation structure does not affect displacement of other vertical isolation structures nor of the mesh network 60. In an example, any of the spring-constant of the coil spring 12, the height of the coil spring 12, the firmness or compression value of the pad 16, the thickness of the pad 16, or any combination of the above characteristics may be configured to further ensure that vertical displacement of the vertical isolation structure 10 does not result in inadvertent displacement of the mesh network 60.

In an embodiment, the pads (e.g., pad 16) are larger in cross section than the respective caps (e.g., cap 14). In this way, the sides of the pads contract one another to ensure that no gaps exist between the pads while simultaneously ensuring that the caps do not contact one another (e.g., during vertical deflection).

In an alternate embodiment, if the mesh network 60 happens to be displaced vertically, the mesh network 60 provides for enhanced lateral rigidity. For example, responsive to an extremely high pressure force on a concentrated area (e.g., a high force on vertical isolation structure 10), the coil spring 12 could deflect to the point where the coil impinges on mesh network 60, thus vertically displacing mesh network 60. If this were to occur, any deflection of the mesh network 60 (e.g., at vertical isolation structure 10) pulls all local nodes (e.g., floating connectors near vertical isolation structure 10) inward toward the point of force. In this way, deflection of mesh network 60 may further enhance the lateral rigidity of the system.

Figure 7:
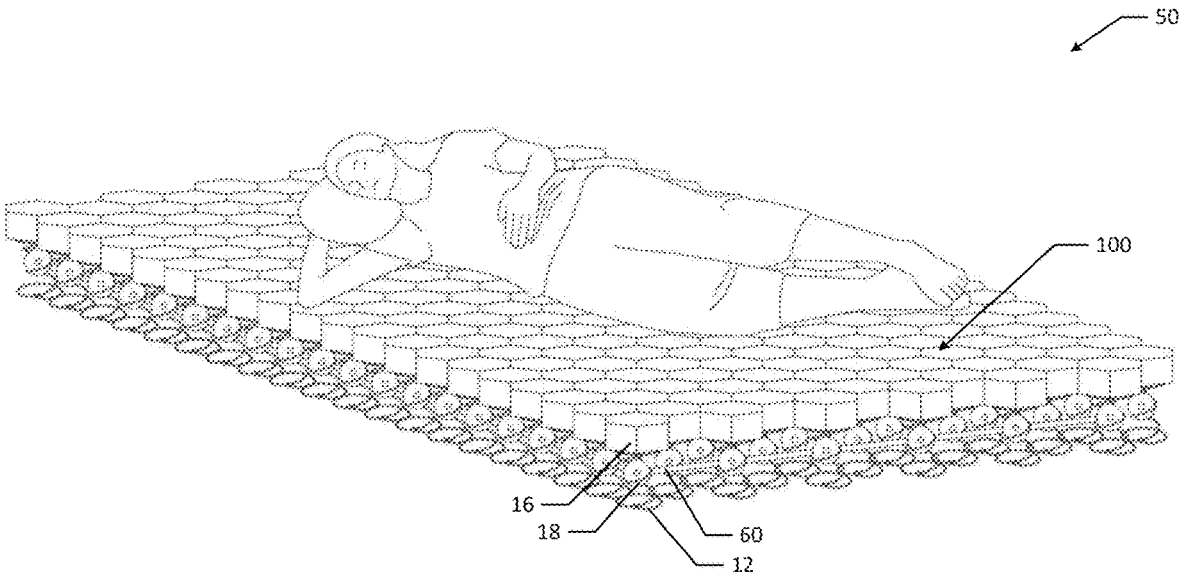
FIG. 7 is a side elevation view of a support structure, according to an example embodiment of the present disclosure.
Figure 8:
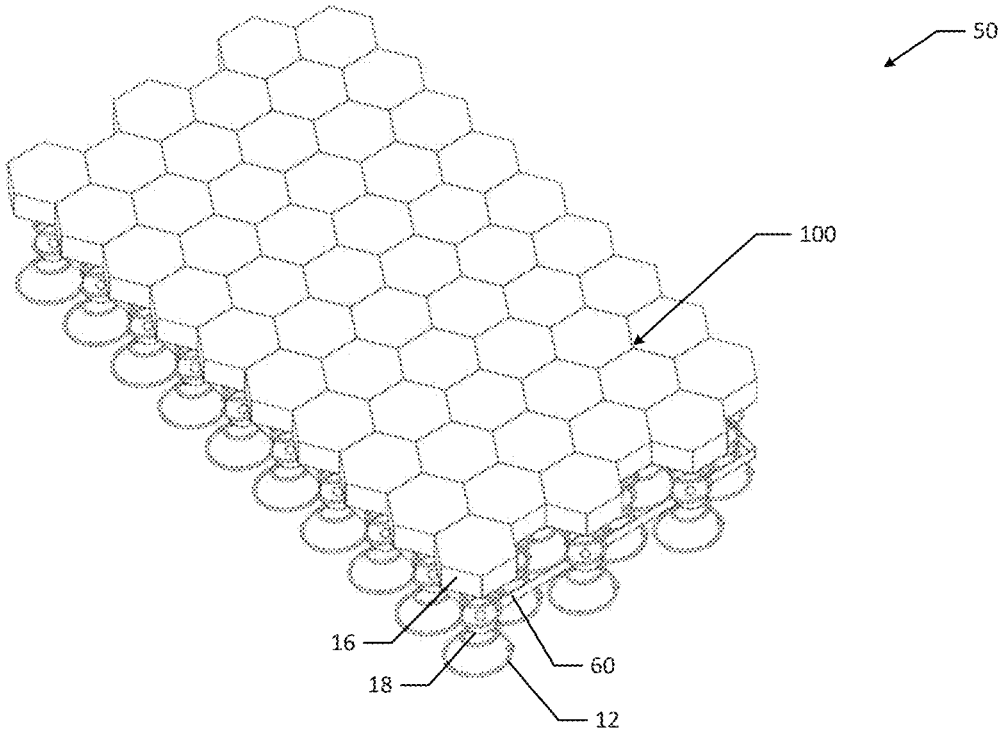
FIG. 8 is a side elevation view of a support structure, according to an example embodiment of the present disclosure.

FIGS. 7 and 8 illustrate side elevation views of the support structure 50, according to an example embodiment of the present disclosure. For example, as previously described, support structure 50 may include a number of vertical isolation structures, each of which have a coil spring 12, a pad 16, coupled to a cap (not shown), a floating connector 18, and other related components. The support structure 50 further includes a mesh network 60 configured to secure the vertical isolation structures to one another. The mesh network 60 ensures both that the vertical isolation structures are vertically independent with respect to one another and that the vertical isolation structures are laterally rigid with respect to one another. As depicted in FIG. 7, support structure 50 may be rectangular-shaped, thus defining a rectangular-shaped support surface 100. It should be appreciated that support structure 50 may be other geometric shapes, such as square, triangular, hexagonal, octagonal, or any other related geometric profile defining support surface 100. In an embodiment, support structure 50 is a mattress, configured for the user to sleep on support surface 100. In other embodiments, support structure 50 and support surface 100 may be implemented with chairs, couches, stools, ottomans, or any other related means as a surface for either a sleep or rest support structure.

In an embodiment, the pad 16 and other pads of support structure 50 have hexagonal-shaped cross sections. With hexagonal pads, it should be appreciated that each column or row of vertical isolation structures may be offset, to eliminate gaps between the various vertical isolation structures. In a related embodiment, the pads are geometrically fitted to provide the support surface 100, which is a planar surface defined by the pads. The support surface 100 is configured such that no gaps exist between individual pads. Furthermore, the lateral rigidity of the support structure 50, provided by mesh network 60, ensures that support surface 100 is one continual planar surface of pads (e.g., no gaps between pads). In one embodiment, mesh network 60 also runs around the entire periphery of the support structure 50, to further enhance lateral rigidity.

It should be appreciated that the support structure 50 presented herein, including a number of individually isolated pads (e.g., pad 16) provides for ideal customization based on user parameters. For example, the user may identify areas of the support surface 100 that require more support (e.g., the middle of support surface 100, associated with the user's torso or hips) and may identify areas of the support surface 100 that require less support (e.g., the top and bottom of support surface 100, associated with the user's head or feet). Different areas incorporating more or less support, may be any zone of support surface 100, such as any row, column, cell, quadrant, section, or any other suitable variation. Accordingly, the support structure 50 can be configured to custom fit the user, and provide for different firmness (e.g., different pads 16 and related firmness, different coil springs 12 and related coil spring spring-constants and/or coil spring height, or any related combination) for particular areas of the support surface 100. Because the vertical isolation structures 10 are not encased, the individual vertical isolation structures 10 can be readily accessed for firmness configuration, installing appropriate pads as desired. Likewise, the individual vertical isolation structures 10 can be readily accessed for any repair (e.g., pad replacement) on a spring-by-spring basis. This improves both the speed of repair and the costs associated with repairing the support structure 50, as faulty springs/pads can be readily identified and replaced. Furthermore, replaced springs/pads can be individually shipped directly to the user, thus reducing shipping costs.

In an embodiment, and with reference to description above, the support structure 50 presented herein implements additional components to custom fit the user. Specifically, the support structure 50 herein may provide for digital fitting of individual pads (e.g., pad 16) and springs (e.g., coil spring 12) to customize a pixelated support structure 50 for the user. With reference to FIGS. 1 and 7 above, each of the vertical isolation structures 10 in support structure 50 may further include a force sensor, such as a pressure transducer. For example, the force sensor may be located above pad 16, between pad 16 and cap 14, between cap 14 and spring 12, below spring 12, or at any other convenient location on vertical isolation structure 10. The force sensor for each vertical isolation structure 10 may communicate (e.g., via wired or wireless communication) with a processor and memory, which may further communicate with a display or other related peripherals. Responsive to a force input (e.g., the user lying on support structure 50), the support structure 50 may provide analysis on a pixel-by-pixel basis (e.g., for each vertical isolation structure 10). The support structure 50 may analyze measured data, provide recommendations, and display recommendations. This information may be useful, for example, to provide discrete customization of both individual pads and springs, to customize the support structure 50 for the user. In a related embodiment, the digital fitting may further include a software application, running on the processor and memory, which may provide the user with the information, such as measured data (e.g., from the force sensors) on the pixel-by-pixel basis, summary data (e.g., identification of high-pressure points on support structure 50), and recommendation data (e.g., recommended vertical isolation structures 10 for particular areas of support structure 50).

In another embodiment sensors, such as the force sensors described above, may provide additional information to the user with respect to support structure 50. For example, the force sensors on each of the vertical isolation structures 10 in support structure 50 may identify and record user-movement over time. This may be useful, for example, to monitor the user's sleep cycle and quality of sleep (e.g., light sleep cycle time, deep sleep cycle time, total sleep time, and other related sleep metrics) associated with support structure 50. The user could further customize the support surface 100 (e.g., increasing the firmness of the middle of support surface 100, associated with the user's torso or hips) and subsequently monitor whether sleep cycle and quality of sleep improve after customization. In this way, the user can optimize the customized support structure 50 over time. Force sensors may communicate with the processor and memory, as described above. Additionally, or alternatively, force sensors may communicate with an external device that has its own processor and memory, such as a cell phone or other personal electronic device, to provide information directly to that external device. The external device may further include software (e.g., an application) running on its processor and memory, such that information regarding support structure 50 is provided directly to the user (e.g., provided via an app running on a user's cell phone).

In a related embodiment, sensors, such as the force sensors as described above, may detect additional parameters, besides user-movement. For example, high-sensitivity force sensors may detect the user's heart rate and identify heart rate as distinct from user-movement. The user's heart rate (e.g., resting heart rate) may further be associated with quality of sleep, as described above.

In a different embodiment, sensors, such as the force sensors as described above, may be incorporated with support structure 50 to detect when an individual vertical isolation structure 10 requires replacement. For example, the sensor for an individual vertical isolation structure 10 may initially be calibrated to an expected force value, based on the user's size and weight. Over time, responsive to deterioration of the vertical isolation structure 10 (e.g., deterioration of pad 16, deterioration of coil spring 12, or any other related component), a measured force value may be significantly higher than the expected force value. For example, the pad 16 and/or the coil spring 12 are over-deflecting (e.g., due to a loss in firmness), thus resulting in an increased measured force value. In this way, the force sensors can readily identify if any of the vertical isolation structures require replacement.

Figure 9:
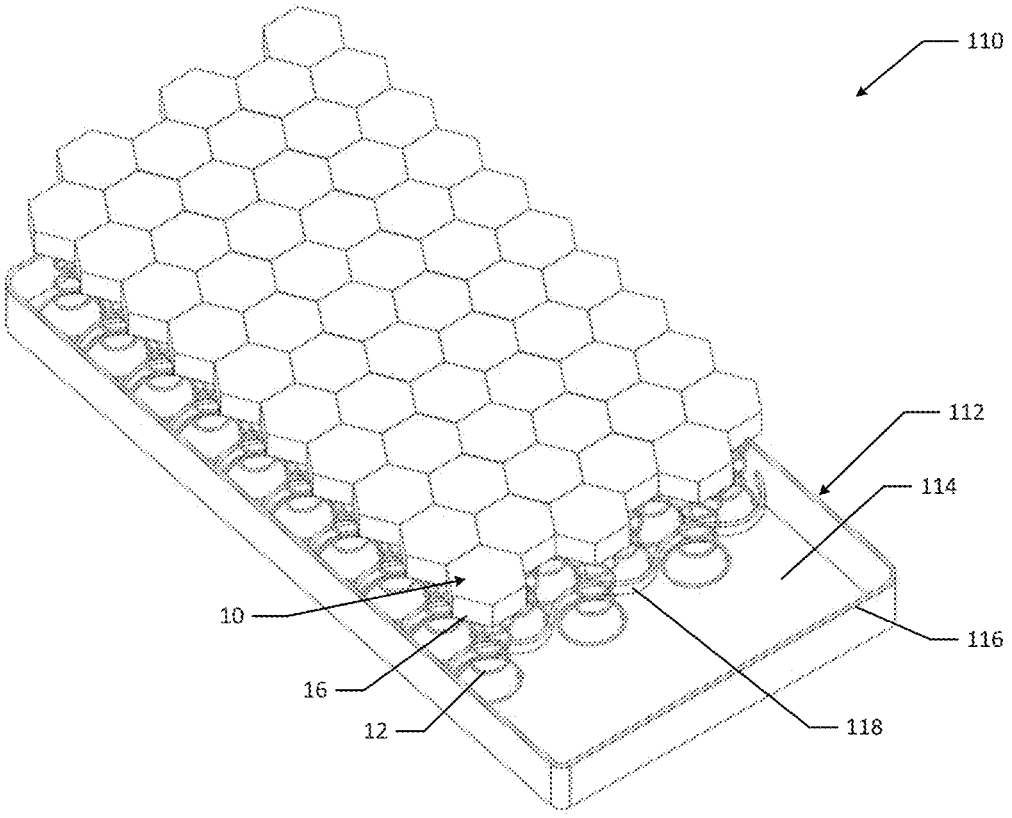
FIG. 9 is a side elevation view of a support structure, according to an example embodiment of the present disclosure.

FIG. 9 illustrates a side elevation view of a support structure 110, according to an example embodiment of the present disclosure. Support structure 110 may include the coil spring 12 and the pad 16, defining vertical isolation structure 10. In addition to vertical isolation structure 10, support structure 110 includes a number of additional vertical isolation structures. It should be appreciated that support structure 110 may include any additional components, such as those previously illustrated and described above.

Similar to FIGS. 7 and 8, the vertical isolation structure 10 in FIG. 9 and the additional vertical isolation structures are arranged in a rectangular array. In an embodiment, a bottom end of each of the springs (e.g., coil spring 12) is seated in a retaining structure 112. Retaining structure 112 may include a base 114 and a wall 116. The wall 116 may extend upward, from the base 114, such that the wall 116 retains an outer periphery the rectangular array that defines the support structure 110. Retaining structure 112 may further include internal fins 118. The internal fins 118 may extend upward, from the base 114, such that the internal fins 118 retain the bottom end of each of the springs (e.g., coil spring 12) individually, in rows, in columns, or in another configuration. In an embodiment, the internal fins 118 are curved, to accommodate for the offset orientation of hexagonal pads associated with the vertical isolation structures.

Figure 10:
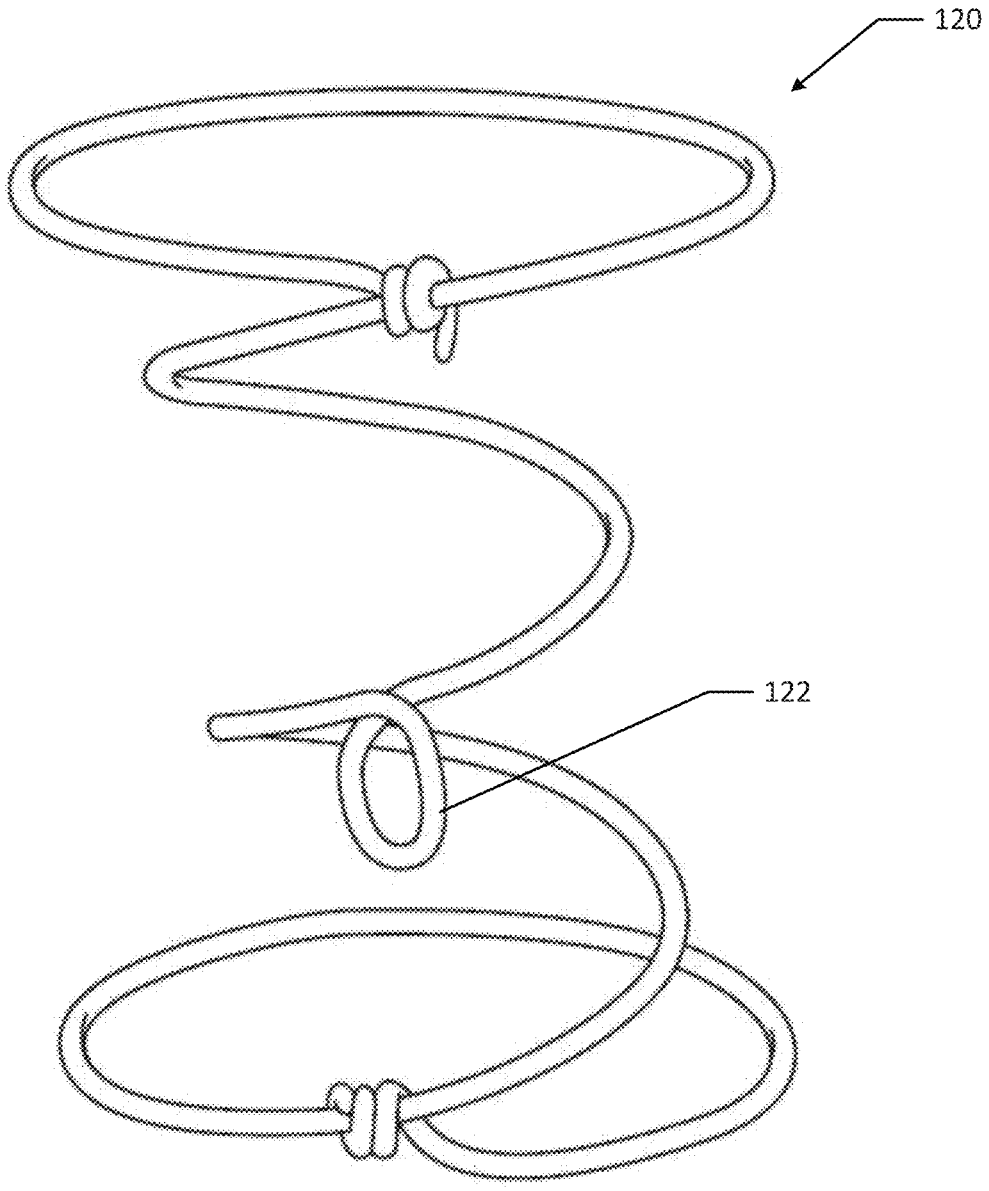
FIG. 10 is a side elevation view of an alternate spring coil, according to an example embodiment of the present disclosure.

FIG. 10 illustrates a side elevation view of an alternate coil spring 120, according to an example embodiment of the present disclosure. The alternate coil spring 120 may include a coil loop 122, positioned at a mid-point of the coil spring. Preferably, the coil loop 122 is manufactured during the manufacturing of the coil spring 120. In an embodiment, the coil loop 122 is used in conjunction with the mesh network 60 and the floating connector 18, to ensure lateral rigidity of the system. In an alternate embodiment, the coil loop 122 is used as a substitute for the floating connector 18, such that the mesh network 60 may pass directly through the coil loop 122 and a number of other coil loops on a number of other alternate coil springs.

Figure 11:
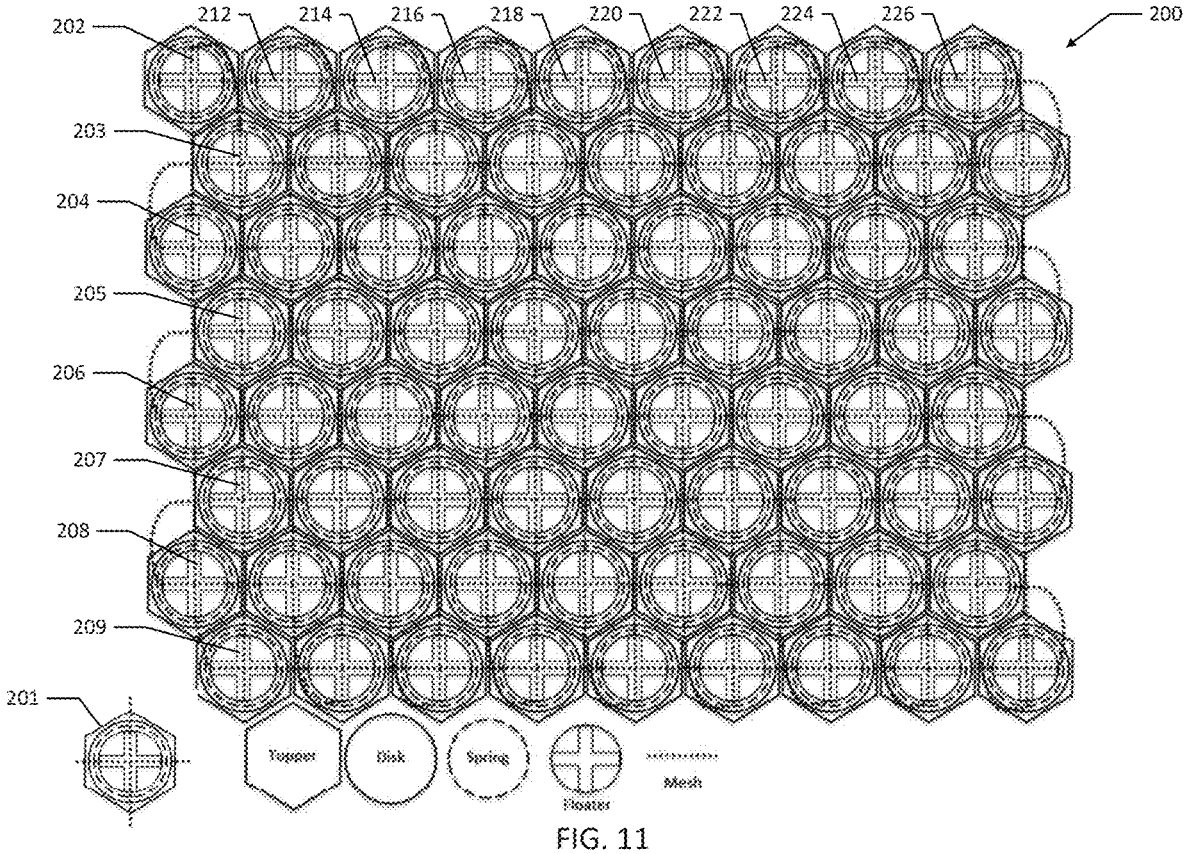
FIGS. 11 to 12 are schematics of a mesh network, according to an example embodiment of the present disclosure.
Figure 12:
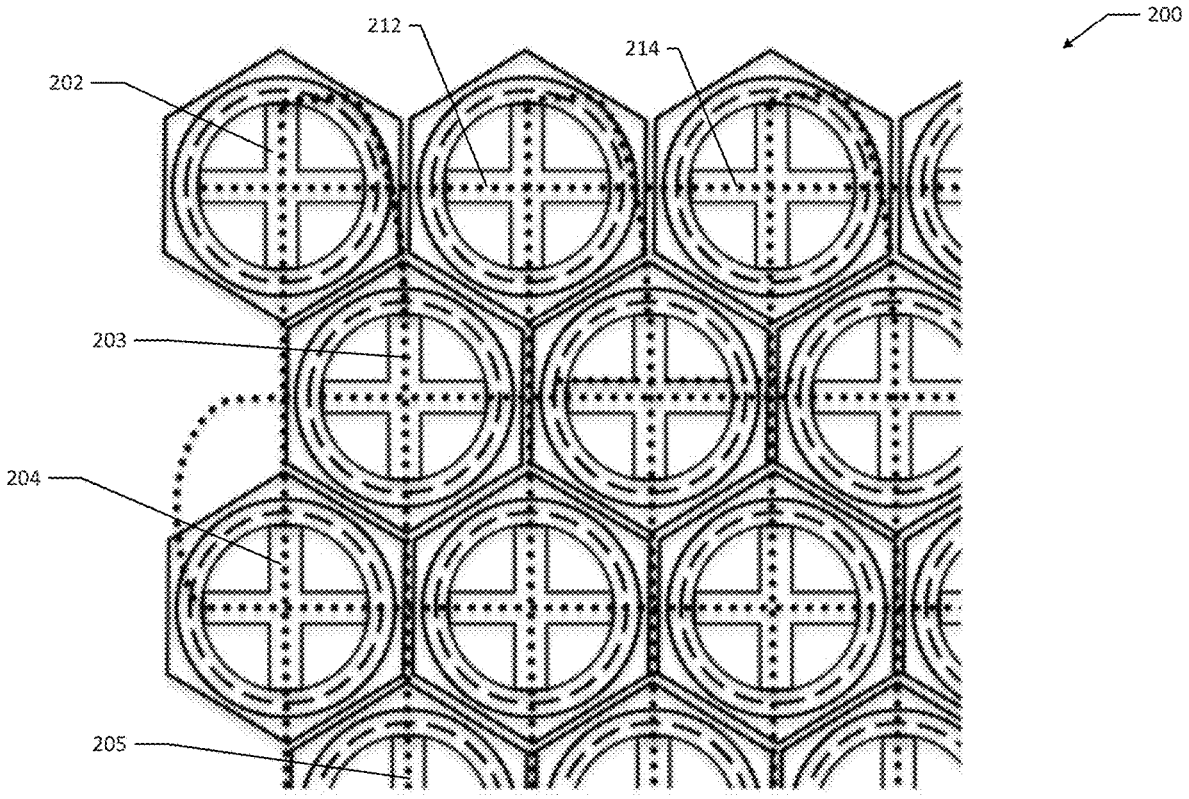

FIGS. 11 to 12 illustrate schematics of a mesh network 200, according to an example embodiment of the present disclosure. It should be appreciated that the schematics in FIGS. 11 to 12 are top-down views of the mesh network (e.g., looking down onto the support surface 100 of support structure 50). Furthermore, it should be appreciated that components (e.g., floating connector 18, pad 16, and cap 14) are depicted as transparent to illustrate mesh network 200. An example component 201 of mesh network 200 is provided as a key. Example component 201 includes a topper (e.g., pad 16), a disk (e.g., cap 14), a spring (e.g., coil spring 12), a floater (e.g., floating connector 18), and mesh (e.g., mesh network 60). For example, example component 201 may be a transparent top-down view of vertical isolation structure 10. All other components described herein with respect to mesh network 200 are similar to example component 201.

The mesh network 200 includes a number of vertical columns and a number of horizontal rows, made up of individual components, such as vertical isolation structure 10. For example, mesh network 200 may include a first column defined by components 202, 204, 206, 208. Likewise, for example, mesh network 200 may include a second column defined by components 203, 205, 207, 209. Similarly, mesh network 200 may include a first row defined by components 202, 212, 214, 216, 218, 218, 220, 222, 224, 226. The mesh network 200 passes through a floating connector for each of these components. For example, the mesh network 200 passes through components 202, 204, 206, 208, to retain the first column. Likewise, the mesh network 200 passes through components 203, 205, 207, 209, to retain the second column. Likewise, the mesh network 200 passes through components 202, 212, 214, 216, 218, 218, 220, 222, 224, 226, to retain the first row.

Furthermore, the mesh network 200 retains columns and rows to one another. For example, the mesh network 200 retains the first column (e.g., components 202, 204, 206, 208) to the second column (e.g., components 203, 205, 207, 209). Likewise, the mesh network 200 retains the first column (e.g., components 202, 204, 206, 208) to the first row (e.g., components 202, 212, 214, 216, 218, 218, 220, 222, 224, 226). In an embodiment, the mesh network 200 forms a matrix, retaining each individual column to any adjacent column and retaining each individual row to any adjacent row.

While FIGS. 11 to 12 illustrate one example of mesh network 200, it should be appreciated that many other configurations for each of the topper, disk, spring, floater, and mesh are possible.

The many features and advantages of the present disclosure are apparent from the written description, and thus, the appended claims are intended to cover all such features and advantages of the disclosure. Further, since numerous modifications and changes will readily occur to those skilled in the art, the present disclosure is not limited to the exact construction and operation as illustrated and described. Therefore, the described embodiments should be taken as illustrative and not restrictive, and the disclosure should not be limited to the details given herein but should be defined by the following claims and their full scope of equivalents, whether foreseeable or unforeseeable now or in the future.

The invention is claimed as follows:

1. A support structure comprising:

a plurality of spring coils, wherein each spring coil of the plurality of spring coils includes:

a spring, a cap, configured to engage the spring, and a floating connector, disposed in a middle of the spring; and a mesh network, wherein the mesh network secures a first spring coil of the plurality of spring coils to a second spring coil of the plurality of spring coils by passing through the floating connector of each of the first spring coil and the second spring coil.

2. The support structure of claim 1, wherein the spring is a Bonnell coil spring.

3. The support structure of claim 1, wherein each spring coil of the plurality of spring coils further includes a pad coupled to the cap.

4. The support structure of claim 3, wherein the pad is coupled to the cap via hook-and-loop fasteners.

5. The support structure of claim 3, wherein the pad has a hexagonal-shaped cross section.

6. The support structure of claim 5, wherein the pad of each spring coil of the plurality of spring coils is geometrically fitted to provide a planar surface with every other pad of the plurality of spring coils.

7. The support structure of claim 1, wherein the floating connector includes two voids, each of the two voids intersecting one another at a center of the floating connector, and wherein the two voids are perpendicular to one another.

8. The support structure of claim 1, wherein the floating connector is a spherical floating connector.

9. The support structure of claim 1, wherein, by securing the first spring coil to the second spring coil, the mesh network prevents lateral displacement by either of the first spring coil and the second spring coil while simultaneously allowing independent vertical displacement by either of the first spring coil and the second spring coil.

10. The support structure of claim 1, wherein the plurality of spring coils is arranged in a rectangular array.

11. The support structure of claim 10, wherein a bottom end of each of the springs is seated in a retaining structure, the retaining structure including a wall that retains an outer periphery of the rectangular array.

12. A vertical isolation structure comprising:

a coil spring;

a circular cap, the circular cap including two deflection arms, wherein each of the two deflection arms is configured to deflect to engage a top end of the coil spring;

a pad, coupled to the circular cap, wherein the pad has a hexagonal-shaped cross section; and a floating connector, disposed in a middle of the coil spring, wherein the floating connector includes two voids, each of the two voids intersecting one another at a center of the floating connector, and wherein the two voids are perpendicular to one another.

13. The vertical isolation structure of claim 12, wherein the coil spring is a Bonnell coil spring.

14. The vertical isolation structure of claim 12, wherein the pad is coupled to the circular cap via hook-and-loop fasteners.

15. The vertical isolation structure of claim 12, wherein the pad includes a first layer and a second layer, the first layer having a first firmness and the second layer having a second firmness that is different from the first firmness.

16. The vertical isolation structure of claim 12, wherein the floating connector is a spherical floating connector connected, via a mesh network passing through the floating connector, to a plurality of other vertical isolation structures at a plurality of other floating connectors.

17. The vertical isolation structure of claim 16, wherein responsive to the vertical isolation structure being displaced vertically, none of the plurality of other vertical isolation structures are displaced vertically.

18. The vertical isolation structure of claim 17, wherein vertical displacement includes compression of both the coil spring and the pad.

19. The vertical isolation structure of claim 12, wherein the coil spring further includes a coil loop, the coil loop positioned at a mid-point of the coil spring.

20. A support structure comprising:

a plurality of spring coils, wherein each spring coil of the plurality of spring coils includes:

a spring, a cap, configured to engage the spring, and a connector, disposed in an interior of the spring; and a mesh network, configured to secure a first spring coil of the plurality of spring coils to a second spring coil of the plurality of spring coils by passing through the connector of each of the first spring coil and the second spring coil, wherein each of the first spring coil and the second spring coil are not displaceable in a lateral direction, and wherein each of the first spring coil and the second spring coil are independently displaceable in a vertical direction.

* * * * *